United States Patent [19]

Fahrbach

[11] Patent Number: 4,768,726

[45] Date of Patent: Sep. 6, 1988

[54] TOROIDAL COIL WINDING MACHINE TO WIND A TOROIDAL CORE HAVING A SMALL OPENING

[75] Inventor: Rudolf Fahrbach, Branchville, N.J.

[73] Assignee: Universal Manufacturing Co., Inc., Irvington, N.J.

[21] Appl. No.: 1,649

[22] Filed: Jan. 9, 1987

[51] Int. Cl.[4] ..... B65H 81/02; H01F 7/06

[52] U.S. Cl. ..... 242/4 R; 242/4 A; 29/605

[58] Field of Search ..... 242/4 R, 4 A; 29/605

[56] References Cited

U.S. PATENT DOCUMENTS

| | | | |
|---|---|---|---|
| 2,959,366 | 11/1960 | Grant et al. | 242/4 R |
| 3,050,266 | 8/1962 | Bucalo | 242/4 A |
| 3,191,878 | 6/1965 | Kitano | 242/4 R |
| 3,811,629 | 5/1974 | Sedgewick | 242/4 A |
| 4,381,600 | 5/1983 | Mas | 242/4 A |
| 4,467,972 | 8/1984 | Kaiser | 242/4 R |
| 4,655,407 | 4/1987 | Rechsteiner | 242/4 A |

*Primary Examiner*—John Petrakes
*Assistant Examiner*—Steven M. DuBois
*Attorney, Agent, or Firm*—Eliot S. Gerber

[57] ABSTRACT

A coil winding machine which winds wire about a toroidal core to form a toroidal coil includes clamping means which removably holds the core and a set of rollers which form a path of movement. The bundle of wires is held on the rollers along the path of movement. A slider means pays-off the wire from the wire bundles and guides it in the direction of the core. The slider is progressed by the rollers relative to the wire bundle coil and is threaded through the hole of the core.

14 Claims, 4 Drawing Sheets

TOROIDAL COIL WINDING MACHINE TO WIND A TOROIDAL CORE HAVING A SMALL OPENING

BACKGROUND OF THE INVENTION

The present invention relates to toroidal coil winding machines.

At the present time a conventional coil winding machine includes a shuttle gear and shuttle magazine, both of which are ring-like. The shuttle magazine is loaded with a supply of wire inserted through the opening (hole) in a toroidal core and rotated about its center to lay the supply of wire on the core. If the core opening is small, then a smaller size of the shuttle magazine and shuttle gear ring must be used. However, the small sizes of shuttle magazines are limited in the size of the wire supply they are able to carry. Either the size (cross-sectional diameter) of the wire must be reduced or fewer turns must be used. If the wire is too thick, or many turns are required, then the shuttle magazine required to carry the wire supply will be too large, in cross-section, to fit through the core opening.

OBJECTIVES AND FEATURES OF THE INVENTION

It is an objective of the present invention to provide a toroidal coil winding machine to wind a wire around a toroidal core in which the wire may be wound into an opening in the core which is too small to receive a wire carrying shuttle.

It is a further objective of the present invention to increase the speed of toroidal coil winding by winding two wires simultaneously on the same core.

It is a still further objective of the present invention to wind the wire about the core tightly and accurately by constantly maintaining the wire under tension so that the wire, as it is being wound, does not form a loop.

It is a feature of the present invention to provide a coil winding machine to wind wire on a toroidal core. Unlike conventional coil winding machines, a shuttle magazine is not passed through the core hole. The coil winding machine includes a base, and mounted thereon, clamp means to removably hold and position a toroidal core.

A series of driven rollers are arranged in tandem to form an imaginary closed curve of rollers. Each roller has a wire retaining means, preferably a channel, to position a wire on the roller. Some of the rollers are arranged in an arc of a circle and driven by a gear ring and others are arranged vertically and driven by individual step motors. A bundle of a continuous length of wire, forming a bundle coil, passes through the core hole and is supported on the rollers by the roller wire retaining means. The wire is payed-out by a slider means which pays-off the wire from the wire bundle and guides it in the direction of the core. The slider is held in contact with the rollers and the slider is progressed by the rollers along the length of the wire bundle core and through the core hole.

It is a further feature of the present invention that the slider is a flexible member having a plastic memory. When the force on the slider is removed, the slider regresses to its normal flat state. When pressure is applied, the slider becomes curved. Preferably, the slider is a U-shaped member having a hole in its bottom wall through which the wire is pulled and guided.

BRIEF DESCRIPTION OF THE DRAWINGS

Other objectives and features of the present invention will be apparent from the following detailed description, taken in conjunction with the accompanying drawings.

In the drawings.

DETAILED DESCRIPTION OF THE INVENTION

The toroidal coil winding machine of the present invention is particularly adapted to wind wire through a small "window" in a toroidal core. The window is the space remaining in the core opening after both parts of the core have been wound with wire, for example, the space of the opening remaining after winding both legs of the core. As an example, it is desired to wind wire around a leg of a metal core, used in an electrial transformer, after both legs have already been wound with a thick wire, leaving only a small window (opening). Generally a much larger window is considered the minimum size of window for practically and economically winding a toroidal core using a shuttle. The wire to be wound about both legs may be round, which is wound to form a coil on the core of many turns; consisting of multiple layers.

Figure 1A:
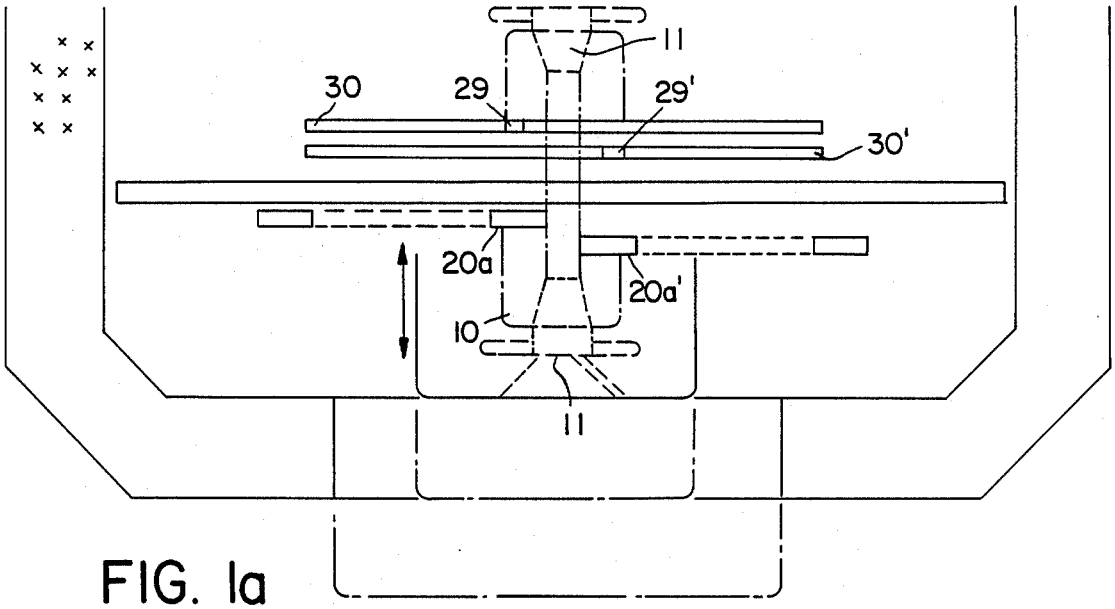
FIG. 1*a* is a top plan view and FIG. 1*b* is a front plan view of the coil winding machine of the present invention.
Figure 1B:
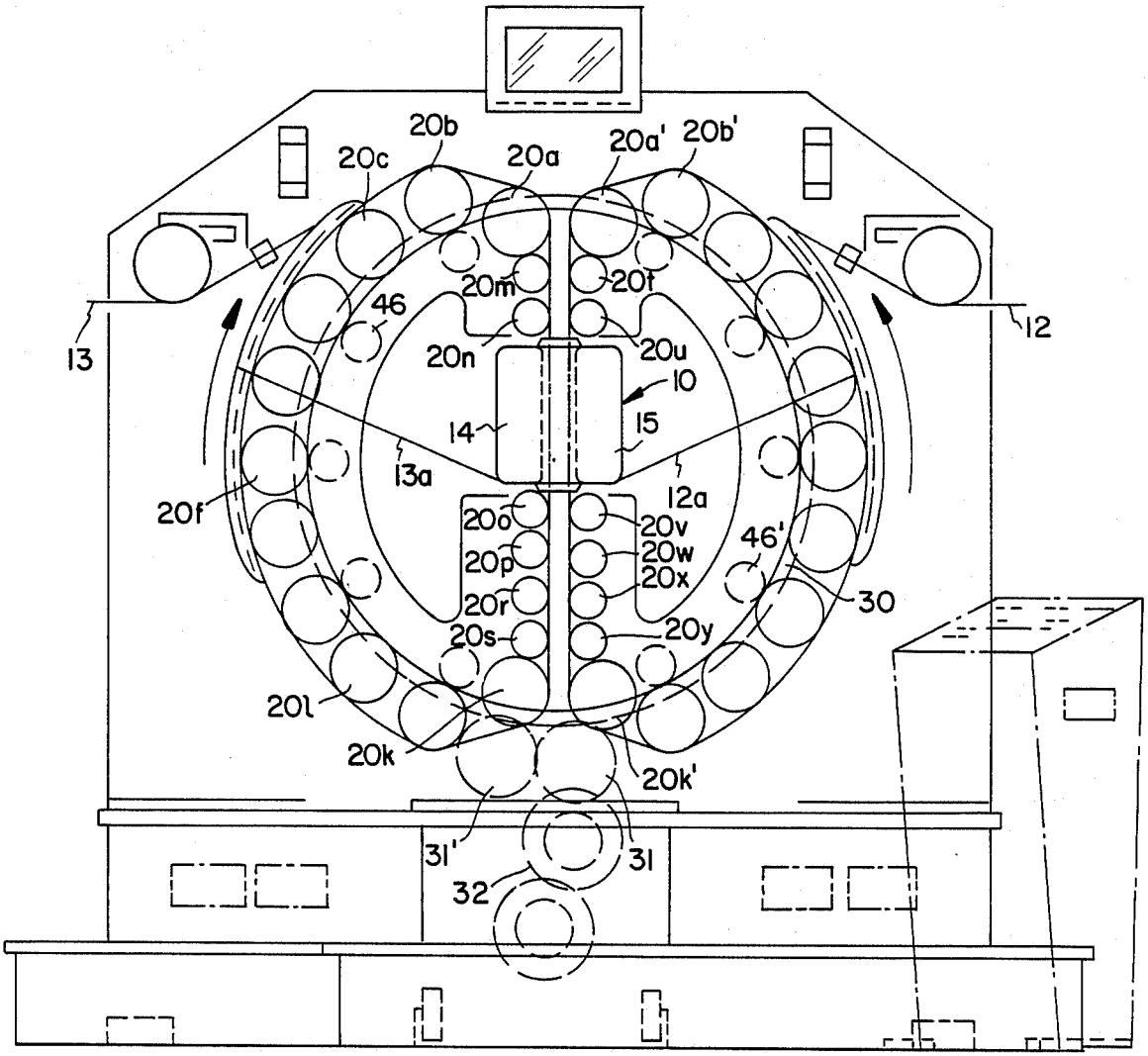
Figure 2A:
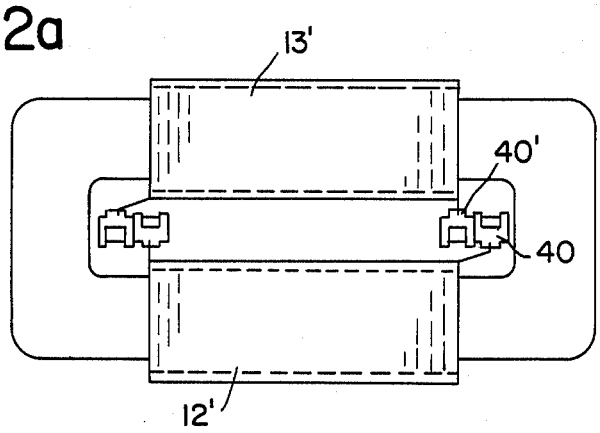
FIG. 2*a* is a top plan view of a transformer which uses the core wound by the machine of FIG. 1.
Figure 2B:
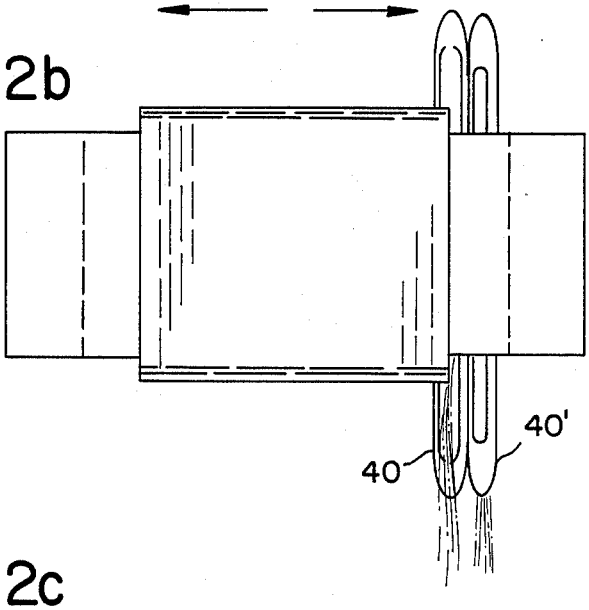
FIG. 2*b* is a side plan view of the transformer of FIG. 1.
Figure 2C:
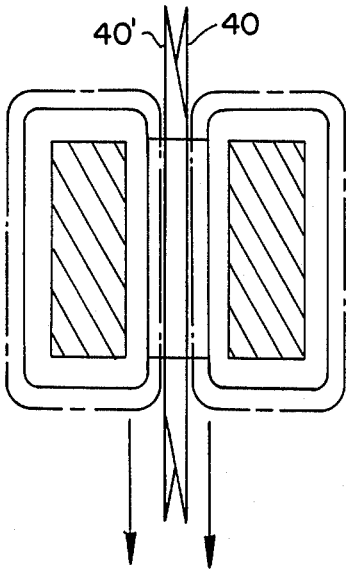
FIG. 2*c* is a cross-sectional view of the transformer of FIG. 2*a;*

As shown in FIG. 1*a* and 1*b*, the toroidal core 10, to be wound, is removably held in a clamp 11 mounted on a base. Two wires 12,13 are simultaneously wound about opposite legs 14,15 of the core to form respective coils 12',13' on those legs, see FIGS. 2*a*–2*c*.

The left and right sides of the coil winding machine are the same, so the following description will be in connection with the left side, as seen in FIG. 1, which side winds the wire 13. The wire 13 is held in its closed curve by a tandem series of driven rollers 20*a*–20*k*, only 34 of the rollers being shown for clarity of illustration. However, preferably there are 40–54 of such rollers 20*a*–20*s*. The description will be of the roller 20*a*, although the other rollers 20*b*–20*k* are of the same size, construction and operation. Rollers 20*m*–20*s* are of similar size, construction and operation.

Figure 3:
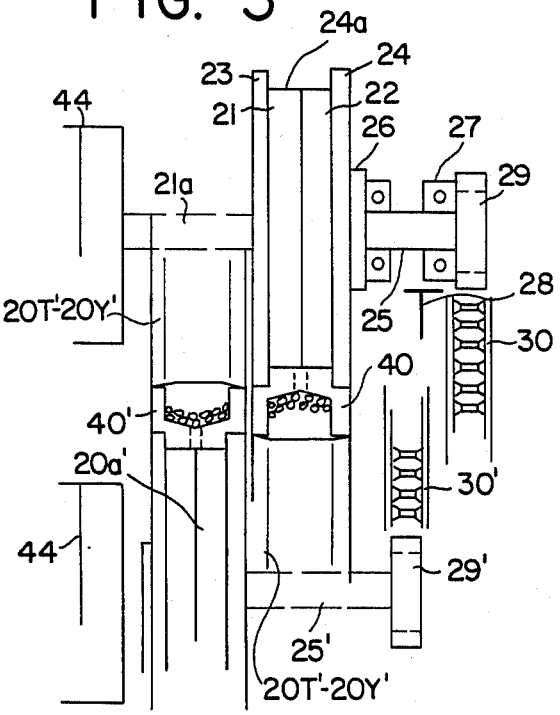
FIG. 3 is a side plan view of a roller before it is split into two rollers.
Figure 4:
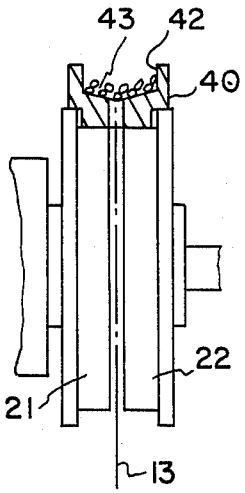
FIG. 4 is a side plan view of the roller of FIG. 3 after it is split into two rollers.

As shown in FIGS. 3 and 4, the roller 20*a* is formed from two symmetric rollers 21,22, each having an outside shoulder flange 23,24 which forms a channel 24*a*.

The roller 22 is mounted on shaft 25 having a flange 26. When the shaft 25 rotates the roller 22 rotates with the shaft. The roller 21 is a freely rotatable roller mounted on shaft 21*a*. The facing faces of rollers 21 and 22 have frictional material so that when they are in contact the roller 22 will drive (rotate) the roller 21. The roller 21 is able to move longitudinally in the direction of the axis of the shaft 21*a*. The shaft 25 is held in bearing 27, which bearing 27 is freely rotatable in the support 28 fixed to the base. A gear 29 is fixed on the shaft 25 so that rotation of the gear 29 will rotate the shaft 25. The gear 29 meshes with, and is driven by, the external teeth of ring gear 30. The external teeth of ring gear 30 meshes with, and is driven by, a driving gear 31 connected to the output shaft of a motor 32 via double clutch coupling. A second driving gear 31' meshes with and is driven by driving gear 31. Ring gear 30' meshes with and is driven by driving gear 31'. The ring gear 30' meshes with and drives gear 29' which is connected to a roller 20*a*' by a shaft 25', to drive the right side of the roller assembly simultaneously and in the opposite rotative direction compared to the left side roller assembly.

The outer series of rollers 20*b*–20*k* are of the same construction as roller 20*a* and the rollers 20*a*–20*k* are rotated simultaneously and at the same rotative speed by the gear ring 30. However, the vertically aligned rollers 20*m*–20*n* are driven at different speeds than the rollers 20*o*–20*s*. The rollers 20*m*–20*n* are driven faster than the rollers 20*a*–20*k*, and the rollers 20*o*–20*s* are driven at slower rates of rotative speed than the rollers 20*m*–20*n*. The shafts of the rollers 20*m*–20*s* are connected by timing belts to individual digital step motors, so that each group of the rollers 20*m*–20*n* and 20*o*–20*s* may be driven at a different, selected and exact speed under programmed digital computer control.

The rollers 20*a*–20*k* split into the two half-rollers 21,22 when the wire 13 is taken off from the bundle (coil) of wire 43, see FIG. 4. At that moment the bundle of wire 43 is held up by the slider 40 between the two adjacent rollers. For example, when the wire 13 is pulled out of the slider 40 from between the rollers 21,22 (roller 20*a*) the bundle of wire 43 is held up and retained by the slider 40.

The slider 40 is a flexible U-shaped member which is carried and progressed by the rollers 20*a*–20*k*. The slider 40 is not like the shuttle magazine of the conventional coil winding machine because it does not carry the supply of wire. The inner face of the slider 40 is held and pulled inwardly in its position against the rollers 20*a*–20*k* by the tension of the wire 13*a* (a portion of wire 13) which is pulled through the hole 41 of the slider. The bundle of the wire supply 43 fits in the U-shaped channel 42 of the slider 40, see FIG. 4. The slider pulls off the wire from the bundle 43 and directs it toward the core.

The rollers 20*a*–20*k* are opened into their two halves in timed progression with the movement of the slider 40. The roller opens just before it is reached by the hole of the slider. Preferably a pneumatic air cylinder system 44 is employed, although alternatively the rollers may be opened by a mechanical cam system or solenoids which are operated by a trigger system based upon motion of the wire and the slider.

Figure 5:
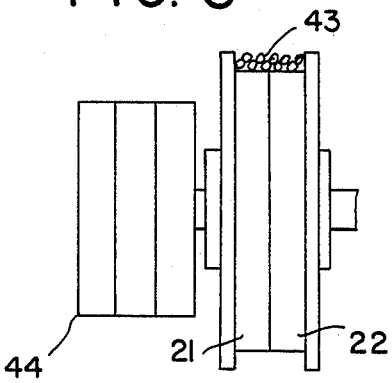
FIG. 5 is a diagram of a mechanism which is used to split the roller of FIG. 3.

In a suitable system the wire 13 will trigger an opto-electric device, which will open the two halves of the roller 20*d*, i.e., the second roller ahead of the wire is opened, see FIG. 4. The leading edge of the slider 40 must be on top of the roller, or already override the roller 20*b*–20*a* retaining the wire bundle 43. When the wire 13, coming from the opening 41 on the slider 40 has passed the open (separated) rollers, those rollers will close before the tail end of the slider 40 will leave the roller behind. The closed rollers will then become a channel 24*a* again, which channel retains the bundle 43 of wire 13, see FIG. 5.

Alternatively, and not shown, the wire 13 of the slider 40 may be detected by an opto-electric device 45 whose output triggers a solenoid which pulls the roller 21 to the left.

The slider 40 is constructed of a flexible elastic material having a "memory", i.e., which returns to a predetermine straight flat shape, in which it was originally molded, when force is removed. A suitable material is the plastic resin polypropylene, which may be flexed millions of times and will tend to return to its original molded shape. The original shape of the slider 40 is flat, so that it may pass through the window of the core. It is forced into the curved shape, to follow the rollers 20*a*–20*k*, by the pulling tension of wire 13*a*. When the slider is flat and moving vertically, in FIG. 1, as it approaches the core it is not held against the rollers by the wire tension; instead it is gripped and progressed by the opposite rollers 20*t*–20*y* and 20*t*'–20*y*'.

In this case two sliders are used (two wires are wound simultaneously); the sliders are positioned so that they will go side by side through the core window.

As shown in FIGS. 1 and 3, the ring gear 30 drives the left outer rollers 20*a*–20*k* and the ring gear 30', the right outer rollers 20*a*–20*k*'.

The ring gears 30 and 30' are supported by rollers 46 and 46', see FIG. 1*b*.

As shown in FIG. 1, the center of the core 10 is preferably positioned above the center of the ring gear 30 and 30' so that the wire may be kept taut, without a loop, as the wire is wound on the core 10.

In operation, the wire 13 is guided for loading onto the rollers (not shown), by hand, forming a bundle 43 of at least one wire about the rollers 20*a*–20*k*. Then the wire is guided through the hole 41 of slider 40. The start lead is connected to the core. This prepares the left side for the winding operation.

Figure 8:
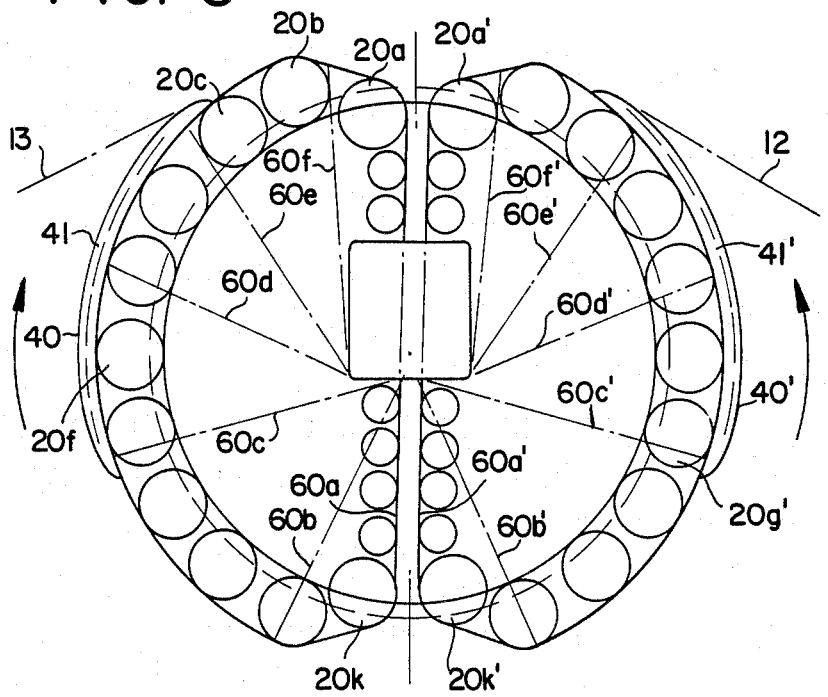
FIG. 8 is a view similar to FIG. 1 and showing various positions of the wire as it is wound on the core.
Figure 6:
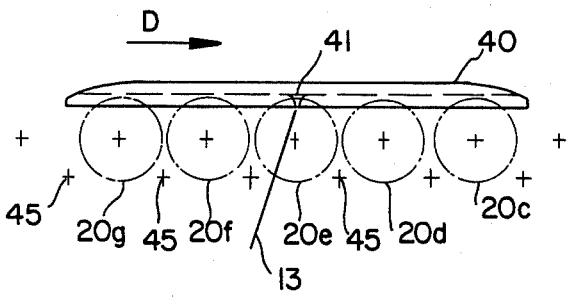
FIG. 6 is a view, compared to FIG. 5, of a slider, the split mechanism and rollers.
Figure 7:
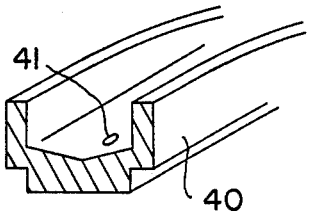
FIG. 7 is a view, partly in cross-section and partly in perspective, of the slider.

Likewise the wire 12 is guided for loading onto the rollers by hand, for the future bunde 43', of at least one wire about the rollers 20*a*'–20*k*', to wind slider 40 under the first turn. Then the wire is guided through the hole 41' of slider 40' and the start lead of wire strand 12 is connected to the core. This prepares the right side for winding. For example, the bundle, at its maximum, may be a coil of wire of 100–150 turns of medium diameter wire. The start of the wire bundle 43 and 43' is formed by setting up the machine and then the slider may start its operation. Additional wire is being fed to the bundle, i.e., wire is fed to the bundle while the core is being wound. The slider is released and moves around the rollers 20*a*–20*k*. As the slider is progressed around those rollers, it pays-off the wire portion 13*a* from the bundle 43. As shown in FIG. 8, the sequence of wire directions, starting from the top in FIG. 8, is 60*a*–60*f*, each wire position 60*a*–60*f* showing a sequential position of the wire portion 13*a* as it is payed-off the wire bundle 43. The winding of the left leg of the coil 13' will now proceed, while the right side with slider 40' must wait, disconnected by a clutch coupling, until the traverse feed has transferred the slider 40' to the start position of the coil 12, see FIG. 2. The right side of the machine will commence winding the right leg of the transformer. After the traverse of the left leg of coil 13' is completed, the left side winding mechanism, disconnected by a clutch coupling, stands still, while the right side winding will continue until the traverse of the right side coil 12' is completed. This operation is repeated until the desired number of layers are laid on the core. When the core or the left and the right core leg has been completely wound with the desired number of turns, the slider is stopped, the completed core removed, and a new core positioned in its place.

What is claimed is:

1. A coil winding machine to wind wire on a toroidal core, the machine including a base, and mounted thereon:

clamp means to removably hold and position a toroidal core;

a series of rollers arranged in tandem to form an imaginary closed curve of rollers forming a path of movement, each roller having wire retaining means to position a wire on the roller;

motor means to rotate said rollers;

a bundle of a continuous length of wire forming a bundle coil which passes through the core hole and is supported on the rollers along said path of movement by the roller wire retaining means;

a slider means to pay-off the wire from the wire bundle and guide it in the direction of the core, said slider means including a slider extending only partially along said path of movement in contact with only some of the rollers and progressed relative to the wire bundle coil by the rollers along the path of movement and the and through the core hole.

2. A coil winding machine as in claim 1 wherein the slider is a flexible member having a plastic memory so that when force thereon is removed it regresses to a normal flat state, and when pressure is applied thereon, by tension from the wire being wound on the core, the slider is curved to contact a plurality of said rollers simultaneously.

3. A coil winding machine as in claim 1 wherein the slider is a U-shaped member having a hole in its bottom wall through which the wire is pulled and guided.

4. A coil winding machine as in claim 1 wherein the motor means includes individual digital computer controlled step motors to drive at least some of said rollers.

5. A coil winding machine as in claim 4 wherein the rollers driven by the step motors are driven at different speeds than the rollers driven by the gear ring.

6. A coil winding machine as in claim 1 including vertical mounting means to mount some of said rollers vertically to form a first set of vertical roller with some of the vertical rollers above the core and others below the core.

7. A coil winding machine as in claim 6 and further including second motor means to drive said second set of vertical rollers.

8. A coil winding machine to wind wire on a toroidal core, the machine including a base, and mounted thereon:

clamp means to removably hold and position a toroidal core;

a series of rollers arranged in tandem to form an imaginary closed curve of rollers forming a path of movement, some of the rollers being arranged in an arc of an imaginary circle and others being aligned vertically, each roller having wire retaining means to position a wire on the rollers;

a ring gear means to drive said rollers in the arc;

motor means to rotate said ring gear and step motors to drive said vertically arranged rollers;

a bundle of continuous length of wire forming a bundle coil which passes through the core hole and is supported on the rollers along said path of movement by the roller wire retaining means;

slider to pay-off the wire from the wire bundle and guide it in the direction of the core, the slider being in contact with only some of the rollers and extending only partially along said path of movement and progressed by the rollers along the path of movement and through the core hole;

wherein the slider is a flexible member having a plastic memory so that when force thereon is removed it regresses to a normal flat state, and when pressure is applied thereon, by the tension of the wire being wound on the core, the slider is curved to contact a plurality of said rollers simultaneously.

9. A coil winding machine to wind wire on a toroidal core the machine including a base, and mounted thereon;

clamp means to removably hold and position a core;

a first and a second series of rollers, arranged in tandem to form a first and a second imaginary closed curve of rollers forming first and second paths of movement; each roller having wire retaining means to position a wire on the roller;

motor means to rotate said rollers;

first and second bundles of a continuous length of wire forming a first and second bundle coil, each of which passes through the core hole and is supported on the respective first and second series of rollers by the roller wire retaining means along said first and second paths of movement;

a first and a second slider means to pay-off the wire from the respective first and second wire bundles and guide each wire in the direction of the core, each slider being in contact with only some of the respective series of rollers and progressed by the said rollers along the respective paths of movement and through the core hole simultaneously so that the sliders are at the same level within the core hole.

10. A coil winding machine as in claim 9 wherein each slider is a flexible member having a plastic memory so that when force thereon is removed it regresses to a normal flat state, and when pressure is applied thereon by the tension of the wire being wound on the core, the slider may be curved to contact a plurality of said rollers simultaneously.

11. A coil winding machine as in claim 9 wherein each slider is a U-shaped member having a hole in its bottom wall through which the wire is pulled and guided.

12. A coil winding machine as in claim 9 wherein the motor means includes individual digital computer controlled step motors to drive at least some of said rollers of each series.

13. A coil winding machine as in claim 9, including a circular ring gear, means to rotatably mount said ring gear, a plurality of driven gears meshing with and driven by said ring gear and means connecting each of said driven gears to a roller, wherein said motor means drives said ring gear.

14. A coil winding machine as in claim 1 including a circular ring gear, means to rotatably mount said ring gear, a plurality of driven gears meshing with and driven by said ring gear and means connecting each of said driven gears to a roller, wherein said motor means drives said ring gear.

* * * * *